US005145117A

United States Patent [19]

Satake et al.

[11] Patent Number: 5,145,117

[45] Date of Patent: Sep. 8, 1992

[54] PROCESS OF AND SYSTEM FOR FLOURING WHEAT

[75] Inventors: Toshihiko Satake, Higashihiroshima; Yukio Hosaka, Hiroshima, both of Japan

[73] Assignee: Satake Engineering Co., Ltd., Tokyo, Japan

[21] Appl. No.: 690,674

[22] Filed: Apr. 24, 1991

Related U.S. Application Data

[62] Division of Ser. No. 366,698, Jun. 15, 1989, Pat. No. 5,033,371.

[30] Foreign Application Priority Data

Jun. 16, 1988 [JP] Japan ..... 63-149828

[51] Int. Cl.[5] ..... B02C 9/04

[52] U.S. Cl. ..... 241/8; 241/101.8

[58] Field of Search ..... 426/518; 241/21, 6-13, 241/101 B, 101.8

[56] References Cited

U.S. PATENT DOCUMENTS 4,661,365 4/1987 Malone ..... 426/518 X

FOREIGN PATENT DOCUMENTS 838239 5/1952 Fed. Rep. of Germany ..... 241/8

*Primary Examiner*—Mark Rosenbaum
*Assistant Examiner*—Peter Dungba Vo
*Attorney, Agent, or Firm*—Darby & Darby

[57] ABSTRACT

A wheat flouring system comprises a polishing machine for polishing wheat grains, a humidifying machine for humidifying the grains, a conditioning machine for subjecting the grains to conditioning and a milling machine for milling the grains to produce a flour. The polishing machine, the humidifying machine, the conditioning machine and the milling machine are successively arranged from an upstream side to a downstream side as viewed in a direction of flow of the wheat grains. There is provided an agitating machine for agitating the grains humidified by the humidifying machine, thereby preventing the humidified grains from sticking together into lumps of the grains.

6 Claims, 2 Drawing Sheets

PROCESS OF AND SYSTEM FOR FLOURING WHEAT

RELATED APPLICATION

This application is a division of application Ser. No. 366,698 filed June 15, 1989 for "Process of and System for Flouring Wheat", now U.S. Pat. No. 5,033,371.

BACKGROUND OF THE INVENTION

1. Field of the Invention

The present invention relates to a process of and a system for flouring wheat.

2. Description of the Prior Art

It has hitherto been known that a wheat flouring process comprises the step of milling wheat grains to produce a flour. Ordinarily, the wheat grains to be milled in the milling step are subjected to pretreatment. The pretreatment process includes the steps of polishing the wheat grains, humidifying the grains and subjecting the grains to a treatment usually referred to as "conditioning".

As well-known, wheat grains each includes an endosperm part which contains starch, gluten-parenchyma and an aleuron layer. The aleuron layer constitutes a surface layer of the endosperm part. The endosperm part is covered with several layers which contain an exosperm ,layer adjacent to the aleuron layer, a testa layer covering the exosperm layer and a layer of pericarp outside the testa layer. The grain also includes embryo. The abovementioned polishing step is performed for stripping and removing from the grains surface portions of the latter including layers of pericarp, testa, exosperm and aleuron.

The polished grains are then humidified, and thereafter subjected to the conditioning. The conditioning of the grains is performed for making the physical and chemical properties of the grains, such as moisture content of the latter, optimum for the subsequent milling operation.

It is to be noted that the term "conditioning" is used in this specification and the appended claims in a broad concept including cold conditioning usually referred to as tempering, warm conditioning, hot conditioning, stabilizer conditioning, drying operation and the like.

Wheat grains obtainable in Japan as raw material for the wheat flouring ordinarily have moisture content of 11 to 12% by weight of the grains. In a wheat flouring process, the wheat grains polished in the polishing step are humidified and then subjected to conditioning so as to increase the moisture content of the grains to the value of 15 to 16% by weight of the grains which is most suitable for the subsequent milling operation. However, when the wheat grains are humidified after they have been polished and hence surface portions of the grains have been partly stripped and removed therefrom, the humidified grains become prone to stick together into lumps of the grains due to an action of gluten and starch contained in the surface portions of the grains. When the lumps of the humidified grains are formed in a tempering tank, for example, they cannot be preferably milled into a flour in the subsequent milling operation.

SUMMARY OF THE INVENTION

It is therefore an object of the invention to provide a process of flouring wheat which may prevent wheat grains from sticking together to form lumps of the grains.

It is another object of the invention to provide a wheat flouring system for carrying out the process.

According to one aspect of the invention, there is provided a process of flouring wheat comprising the steps of: polishing wheat grains; humidifying the polished grains; positively the humidified grains to prevent the latter from sticking together into lumps of the grains; subjecting the humidified and agitated grains to conditioning; and milling the grains to produce a flour.

According to another aspect of the invention, there is provided a system for flouring wheat comprising: means for polishing wheat grains; means arranged downstream of the polishing means for humidifying the grains; means for agitating the grains humidified by the humidifying means, thereby preventing the humidified grains from sticking together into lumps of the grains; conditioning means arranged downstream of the agitating means for subjecting the grains to conditioning; and means for milling the grains to produce a flour.

It is herein to be noted that the term "downstream" used in this specification and the appended claims means "downstream" as viewed in a direction of flow of the wheat grains.

Preferably, the agitating means includes screw conveyor means arranged between the humidifying means and the conditioning means.

Also it is preferable that the polishing means includes a perforated polishing cylinder and a grinding roll rotatably mounted therein. In this case, the polishing cylinder and the grinding roll cooperate with each other to define therebetween a polishing chamber.

According to the invention, surface portions of the wheat grains, other than those attached to the furrow portions thereof, are stripped and removed at least partly by polishing the grains. The polished grains are then humidified and agitated, and thereafter subjected to conditioning to have moisture content optimum for the subsequent milling operation. The grains are then fed to the milling means to produce a finished flour.

, Since the humidified grains are agitated, the grains are prevented from sticking together into lumps of the grains. The agitation of the grains is effective for promoting moisture to permeate into the grains and for rapidly drying surfaces of the latter, so that it may rapidly remove the factors causing sticking of the grains. Thus, the agitation prevents the entire wheat flouring process from being delayed due to formation of the lumps of the grains.

In the case where the agitating means includes the screw conveyor means, the grains may be agitated while being transported. This is advantageous in that a conveyor for transporting the grains serves to agitate the grains and hence additional means need not be provided for causing the agitation of the grains.

The above and other objects, features and advantages of the invention will become more apparent from the following description with reference to the accompanying drawings.

DESCRIPTION OF THE PREFERRED EMBODIMENT

An embodiment of the invention will now be described with reference to the accompanying drawings.

Figure 1:
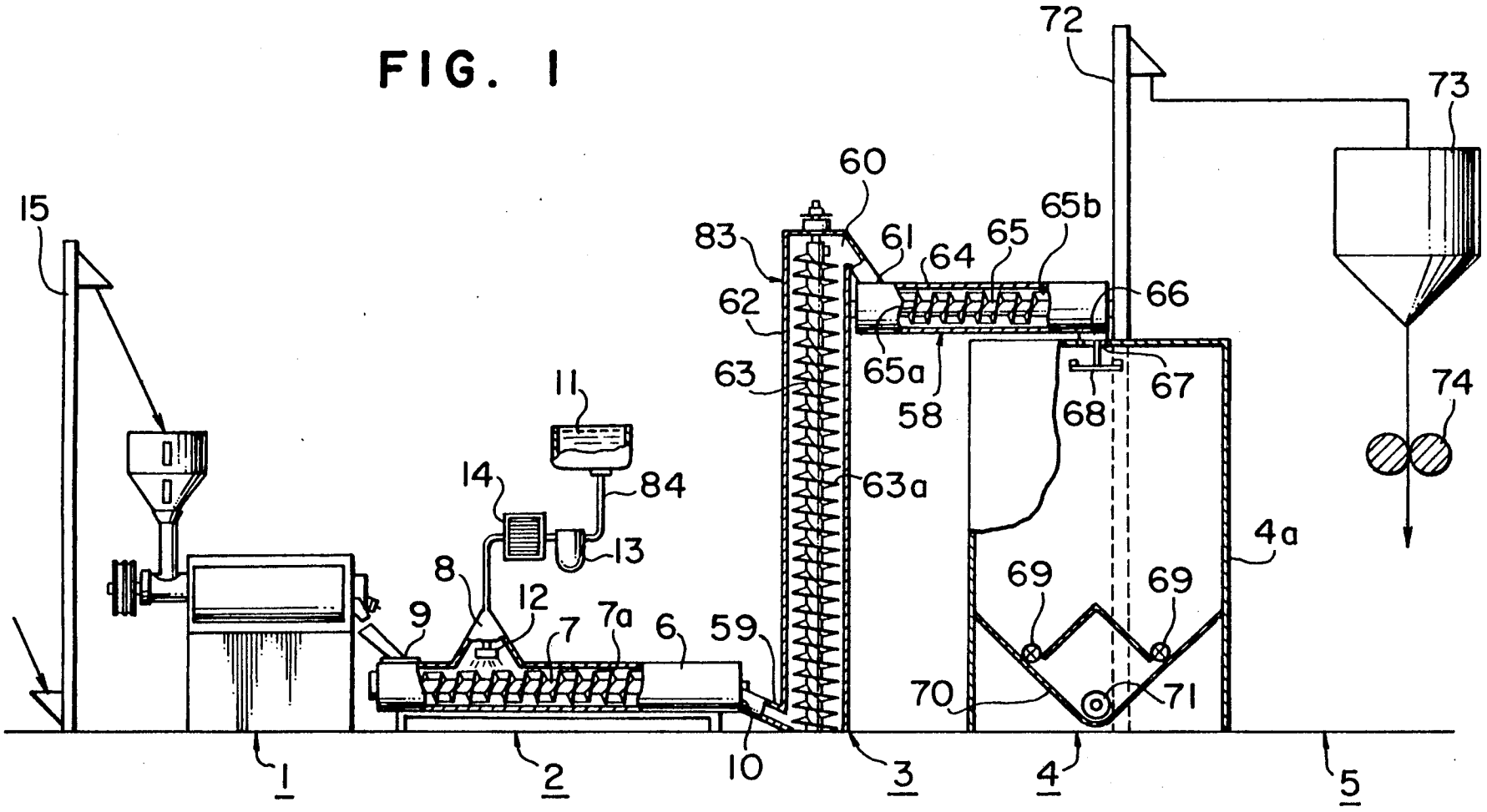
FIG. 1 diagrammatically shows a wheat flouring system constructed in accordance with an embodiment of the present invention.

FIG. 1 shows a wheat flouring system which comprises a wheat polishing machine 1, a humidifying machine or a dampener 2, an agitating machine 3, a conditioning machine 4 and a milling machine 5 arranged successively from an upstream side to a downstream side as viewed in a direction of flow of wheat grains. These respective machines will be described in detail hereunder.

Figure 2:
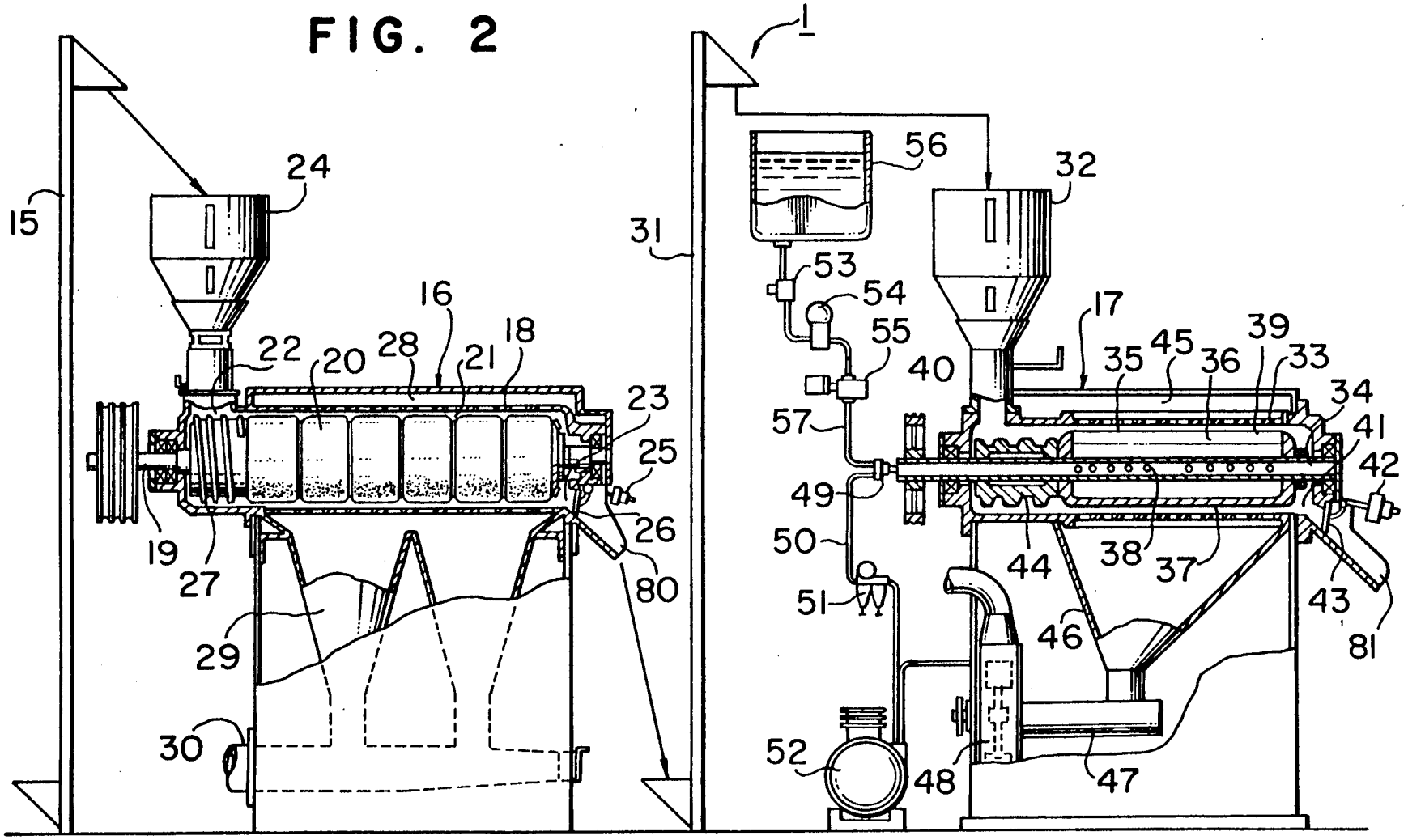
FIG. 2 is an enlarged cross-sectional view of a wheat polishing machine shown in FIG. 1.

As shown in FIG. 2, the wheat polishing machine 1 includes a grinding-type wheat polisher 16 and a humidifying friction-type wheat polisher 17. The grinding-type wheat polisher 16 includes a perforated polishing cylinder 18. A main shaft 19 extends substantially horizontally through the polishing cylinder 18 and is rotatably mounted therein. On the main shaft 19 is mounted for rotation therewith a grinding roll 20 covered with emery. The polishing cylinder 18 cooperates with the grinding roll 20 to define therebetween a polishing chamber 21. The polishing chamber 21 has one end portion formed with an inlet 22 for the wheat grains and the other end portion formed with an outlet 23 for the grains. A supply hopper 24 is disposed above the inlet 22. The outlet 23 is ordinarily closed with a cover plate 26 urged by a weight 25 in a direction to close the outlet 23. A screw feeder 27 having a spiral wing is securely mounted on that part of the main shaft 19 located beneath the inlet 22. A space surrounding the polishing cylinder 18 constitutes a bran collecting chamber 28, and a lower portion of the bran collecting chamber 28 is communicated through a hopper 29 with an exhaust duct 30 which in turn is connected to an exhaust fan not shown through a bag filter also not shown. A discharge shoot 80 is provided at the outlet 23 to discharge wheat grains therethrough toward an inlet of an elevator 31 provided at a lower portion of the latter. The elevator 31 transports the grains upwardly and supply them to a supply hopper 32 of the humidifying friction-type wheat polisher 17.

The humidifying friction-type wheat polisher 17 includes a perforated polishing cylinder 33 having a polygonal cross-sectional shape such as a hexagonal shape. A hollow main shaft 34 extends substantially horizontally through the polishing cylinder 33 and is rotatably mounted therein. A frictionally polishing roll 37 is mounted on the hollow main shaft 34 for rotation therewith. The polishing roll 37 has agitating projections 35 projecting from an outer periphery of the polishing roll 37 and extending substantially longitudinally of the latter, and slots 36 formed along the agitating projections 35. The hollow main shaft 34 has a number of holes 38 formed in that part of the peripheral wall thereof located within the polishing roll 37. The polishing cylinder 33 cooperates with the polishing roll 37 to define therebetween a polishing chamber 39. The polishing chamber 39 has one end portion and the other end portion formed with an inlet 40 and an outlet 41, respectively, for the grains. The supply hopper 32 is disposed above the inlet 40. The outlet 41 is ordinarily closed with a cover plate 43 urged by a weight 42 in a direction to close the outlet 41. A screw feeder 44 having a spiral wing is securely mounted on that part of the hollow main shaft 34 located beneath the inlet 40. The polishing cylinder 33 is surrounded with a bran collecting chamber 45 having a lower portion communicated with an exhaust fan 48 through a hopper 46 and an exhaust duct 47. A discharge shoot 81 is provided at the outlet 41 to discharge the grains therethrough toward an inlet 9 of the humidifying machine 2.

The humidifying friction-type wheat polisher 17 includes a moisture adding device. The moisture adding device includes a binary fluid nozzle 49 mounted at an end of the hollow main shaft 34 with a nozzle hole thereof communicated with an inner space of the hollow main shaft 34. An air inlet of the binary fluid nozzle 49 is connected to an air compressor 52 through a blast pipe 50 extending therebetween and an air filter 51 mounted thereon. A water inlet of the binary fluid nozzle 49 is connected to a water tank 56 through a water pipe 57 extending therebetween. On the water pipe 57 are mounted a flow regulating valve 55, a flow meter 54 and an electro-magnetic valve 53.

, The humidifying machine 2 includes a trough 6 extending substantially horizontally and having one end and the other end formed with the inlet 9 and an outlet 10, respectively, for the grains. A screw 7 with a spiral wing is rotatably mounted in the trough 6 and extends substantially horizontally. A number of agitating bars 7*a* are connected to the spiral wing of the screw 7 for promoting agitation of the grains. A moisture adding section 8 is defined at that part of the trough 6 near the inlet 9. In the moisture adding section 8 is mounted a jet nozzle 12 while is connected to a water tank 11 through a pipe 84 extending therebetween. A heater 14 for heating water and an electromagnetic valve 13 for regulating the flow rate of water are mounted on the pipe 84.

The agitating machine 3 includes a vertical screw conveyor 83 and a horizontal screw conveyor 58. The vertical screw conveyor 83 includes a vertical trough 62 having a lower end and an upper end formed with an inlet 59 and an outlet 60, respectively. The inlet 59 of the vertical screw conveyor 83 is communicated with the outlet 10 of the humidifying machine 2, while the outlet 60 of the conveyor 83 is communicated with an inlet 61 of the horizontal screw conveyor 58. A screw 63 with a spiral wing 63*a* is rotatably mounted in the vertical trough 62 and extends substantially vertically.

The horizontal screw conveyor 58 includes a horizontal trough 64 and a screw 65 with a spiral wing 65*a* rotatably mounted therein. As similar to the screw 7 of the humidifying machine 2, a number of agitating bars 65*b* are connected to the spiral wing 65*a* of the screw 65. The trough 64 of the horizontal screw conveyor 58 has one end formed with the inlet 61 and the other end formed with an outlet 66. The outlet 66 is communicated with the interior of a tempering tank 4*a* of the conditioning machine 4 through an inlet 67 formed in an upper wall of the tank 4*a*. A grain scatterer 68 having a rotary vane for scattering the grains is mounted in the tempering tank 4*a* as being suspended from the upper wall of the tank 4*a* through the inlet 67. A pair of rotary valves 69 are mounted horizontally at a lower portion of the tempering tank 4*a*. Below the rotary valves 69 is provided a grain receiving trough 70 in which a horizontal screw conveyor 71 for discharging the grains is mounted. The screw conveyor 71 has a downstream discharge end connected to an inlet at a lower end of an elevator 72.

An outlet at an upper end of the elevator 72 is communicated with a regulating tank 73 of the milling machine 5. The milling machine 5 includes a first roll mill 74 disposed below the regulating tank 73 for milling the grains. Although not illustrated, the milling machine 5 includes in a known manner a plurality of further roll mills and a plurality of sifters for repeatedly alternately milling and sifting the grains to provide a finished flour of high quality. Further, it may include in a known manner purifiers for sorting out from the milled and/or sifted grains the grains having large specific gravity and small mesh size.

Next, operation of the embodiment will be described. The wheat grains which have been subjected to selection treatment and hence are free of extraneous substances are transported upwardly by an elevator 15 and are thrown into the supply hopper 24 of the grinding-type wheat polisher 16. The grains are then fed by the screw feeder 27 into the polishing chamber 21, wherein the grains are polished by the rotation of the grinding roll 20 during the polishing operation, the surface portions of the grains, other than those located in furrows, are crushed into fine pieces and scraped off by the emery covering the peripheral surface of the grinding roll 20 rotating at a comparatively high peripheral speed (e.g., 600 mm/min or higher). The grains discharged from the polishing chamber 21 while displacing the cover plate 26 against a pressing force applied by the weight 25 are received in the inlet at a lower portion of the elevator 31. The grains are then transported upwardly by the elevator 31 and thrown into the supply hopper 32 of the humidifying friction-type polisher 17.

The grains thus thrown into the supply hopper 32 is fed into the polishing chamber 39 by the screw feeder 44. The polishing chamber 39 is maintained under a comparatively high pressure (e.g., average pressure of 200 g/cm$^2$ or higher). The grains are agitated under such high pressure by the agitating projections 35 of the frictionally polishing roll 37 rotating at a peripheral speed of less than about one-half of the peripheral speed of the grinding roll 20 of the grinding-type wheat polisher 16. Thus, the grains are agitationally frictionally contacted with each other in the polishing chamber 39. While the grains are being agitated, water or moisture injected in a mist form through the nozzle hole of the binary fluid nozzle 49 into the hollow main shaft 34 flows into the inner space of the frictionally polishing roll 37 through the holes 38 formed in the peripheral wall of the hollow main shaft 34, and is jetted into the polishing chamber 39 through the slots 36. The moisture thus jetted into the polishing chamber 39 humidifies surface portions of the grains, thereby increasing the frictions thereamong. Thus, the removal of the surface portions of the grains is advantageously promoted and the surface portions fast attached to the inner portions of the grains may be stripped and removed. The added moisture exits out of the perforated polishing cylinder 33 together with the bran by the air jetted through the slots 36.

The wheat grains discharged from the humidifying friction-type wheat polisher 17 through the outlet 41 and the discharge shoot 81 are fed into the inlet 9 of the humidifying machine 2. The grains fed into the humidifying machine 2 are moistened in the moisture adding section 8 by water jetted through the jet nozzle 12 in a shower-like manner while they are being transported and agitated by the screw 7 having the agitating bars **7*a*. The grains which have been moistened in the moisture adding section 8 are further transported and agitated by the screw 7, and discharged through the outlet 10 toward the inlet 59 of the vertical screw conveyor 83, while the grains are transported and agitated by the screw 7**, the moisture is distributed uniformly in the surface portions of the grains.

The grains fed to the inlet 59 of the vertical screw conveyor 83 is transported upwardly by the screw 63. Although the surfaces of the grains to which moisture has been added become sticky due to an action of gluten and starch, the grains are prevented from sticking together because of the agitating action caused by the screw 63 while the grains are transported by the latter. While the grains are transported and agitated by the screw 63, moisture is attached to the surface portions of the grains further uniformly and permeation of the moisture into inner parts of the grains is promoted.

When the heater 14 in the humidifying machine 2 is energized to heat water and a warm water thereby produced is fed into the moisture adding section 8 for moistening the grains, the moistening operation becomes further effective.

The grains transported to the upper end of the vertical screw conveyor 83 is fed through the outlet 60 into the inlet 61 of the horizontal screw conveyor 58, and are transported and agitated in the screw conveyor 58 by the screw 65 having the agitating projections **65*b*. The grains transported to the downstream end of the horizontal screw conveyor 58 almost all have surfaces in a dried state since moisture having been attached to the surfaces is absorbed into the inner parts of the grains. The grains having the dried surfaces are discharged from the screw conveyor 58 through the outlet 66, and introduced into the tempering tank 4*a* as being scattered by the rotation of the rotary vane of the grain scatterer 58. Thus, the grains introduced into the tempering tank 4*a*** do not end to stick together into lumps of the grains.

The grains introduced into the tempering tank **4*a*** are left therein for 24 to 48 hours, whereby the moisture is uniformly distributed in the entire grains and the grains become a state most suitable for the subsequent flouring operation.

The grains having been left in the tempering tank **4*a* for the abovementioned time period are fed into the grain receiving trough 70 by the rotation of the rotary valves 69, in turn transported to the inlet at the lower end of the elevator 72 by means of the screw conveyor 71, in turn transported upwardly by the elevator ,72, and in turn thrown into the regulating tank 73 of the milling machine 5. The first milling operation is then effected by the first roll mill 74**.

The detailed description on the subsequent flouring operation performed in the milling machine 5 is eliminated since it is well-known in the art. Briefly describing, the grains are repeatedly alternately milled and sifted by the plurality of roll mills and sifters, and when the purifiers are incorporated in the milling machine the grains are suitably sorted out according to specific gravity and mesh size of the grains. Thus, a flour having a desired mesh size is obtained.

What is claimed is:

1. A process of flouring wheat comprising the steps of:

polishing wheat grains;

humidifying the polished grains;

transporting the humidified grains and imparting positive independent motion to the humidified grains to agitate the same to thereby prevent the transported humidifed grains from sticking together into lumps of grains;

subjecting the humidified and agitated grains to conditioning; and milling the conditioned grains to produce a flour.

2. A process as set forth in claim 1 wherein said grains are agitated at least immediately after they are humidifed.

3. A process as set forth in claim 1 wherein said agitation takes place while the humidifed grains are being transported from humidifying means to conditioning means.

4. A process as set forth in claim 1 wherein the grains are transported in a direction generally parallel to a given axis, and the positive independent motion is imparted to the grains in a direction substantially transverse to said given axis.

5. A process of flouring wheat comprising the steps of:

polishing wheat grains;

humidifying the polished grains;

transporting and positively agitating the humidified grains to prevent the latter from sticking together into lumps of grains;

subjecting the humidifed and agitated grains to conditioning; and milling the conditioned grains to produce a flour;

said step of transporting the grains includes imparting motion to the grains so as to move the grains axially along a screw-conveyor and the step of agitating includes imparting positive motion to the grains in a direction circumferentially of the axis of the screw-conveyor, this latter step being independent of and in addition to the motion imparted by the screw-conveyor for transporting the grains axially.

6. A process as set forth in claim 5 wherein said transporting and agitating occur simultaneously.

* * * * *